US005859428A

United States Patent [19]

Fruchtman

[11] Patent Number: 5,859,428

[45] Date of Patent: Jan. 12, 1999

[54] BEAM GENERATOR

[76] Inventor: Amnon Fruchtman, 38 Hanassi Harishon Street, Rehovot 76302, Israel

[21] Appl. No.: 869,077

[22] Filed: Jun. 4, 1997

[30] Foreign Application Priority Data

Jun. 12, 1996 [IL] Israel ..... 118638

[51] Int. Cl.[6] ..... H05H 3/02; H05H 1/50

[52] U.S. Cl. ..... 250/251; 315/111.41

[58] Field of Search ..... 250/251; 315/111.41

[56] References Cited

U.S. PATENT DOCUMENTS 5,359,258 10/1994 Arkhipov et al. ..... 315/111.41

5,640,009 6/1997 Hatakeyama ..... 250/251

*Primary Examiner*—Jack I. Berman

*Attorney, Agent, or Firm*—Edwin D. Schindler

[57] ABSTRACT

A method for generating a high flux density neutral atom or molecule beam and a system for carrying out this method. The method comprises generating a plasma of electrons and ionized atoms or molecules, accelerating the ions, effecting charge exchange and converting moving ions to moving neutral atoms or molecules. The charged entities are filtered out thus providing a neutral atom or molecule beam. The plasma is generated by a helicon source, by a novel source here described, or by other means. The ions are accelerated by applying electric and magnetic fields perpendicular to each other.

10 Claims, 6 Drawing Sheets

BEAM GENERATOR

FIELD OF THE INVENTION

Neutral beams are advantageous for the processing of semiconductor materials and for cleaning, since they do not charge the wafer. However, neutral beams are available at low fluxes only. A source for neutral beams at energies of 10–200 eV and fluxes of equivalent current densities of up to a few tenths of A/cm$^2$ was developed. Components of this source can also be employed separately as a dense plasma source for industrial applications.

SUMMARY OF THE INVENTION

The novel device has three main components. The first is a wave source that ionizes gas and generates a plasma. Examples are ECR (Electron Cyclotron Resonance) discharge, a helicon source, and a novel source according to this invention. The second component is a plasma accelerator of the Hall thruster type. Due to an externally applied voltage a large electric field is established in the plasma bulk, in a region that is located in a radial magnetic field. The ions are accelerated by the electric field across the magnetic field, while electrons perform closed drift trajectories perpendicular to both the electric and the magnetic fields. Hall thrusters are employed commercially by the Russians for electric propulsion of space vehicles. Recently, a Hall thruster has been successfully operated at Soreq Nuclear Center Yavne. A distinctive feature of the Hall thruster is that the accelerating electric field is not screened by the plasma but rather extends many skin depths into the plasma. As a result, the time energetic ions spend inside the plasma is longer than in the case in which the accelerating field exists in a narrow sheath only and this allows many charge exchange events to occur. Parameters can be adjusted so that the neutral flux is comparable to the ion flux. The third component of the device is a filtering system that confines the plasma while allowing neutral entities to pass.

FIGURE CAPTIONS

Figure 1:
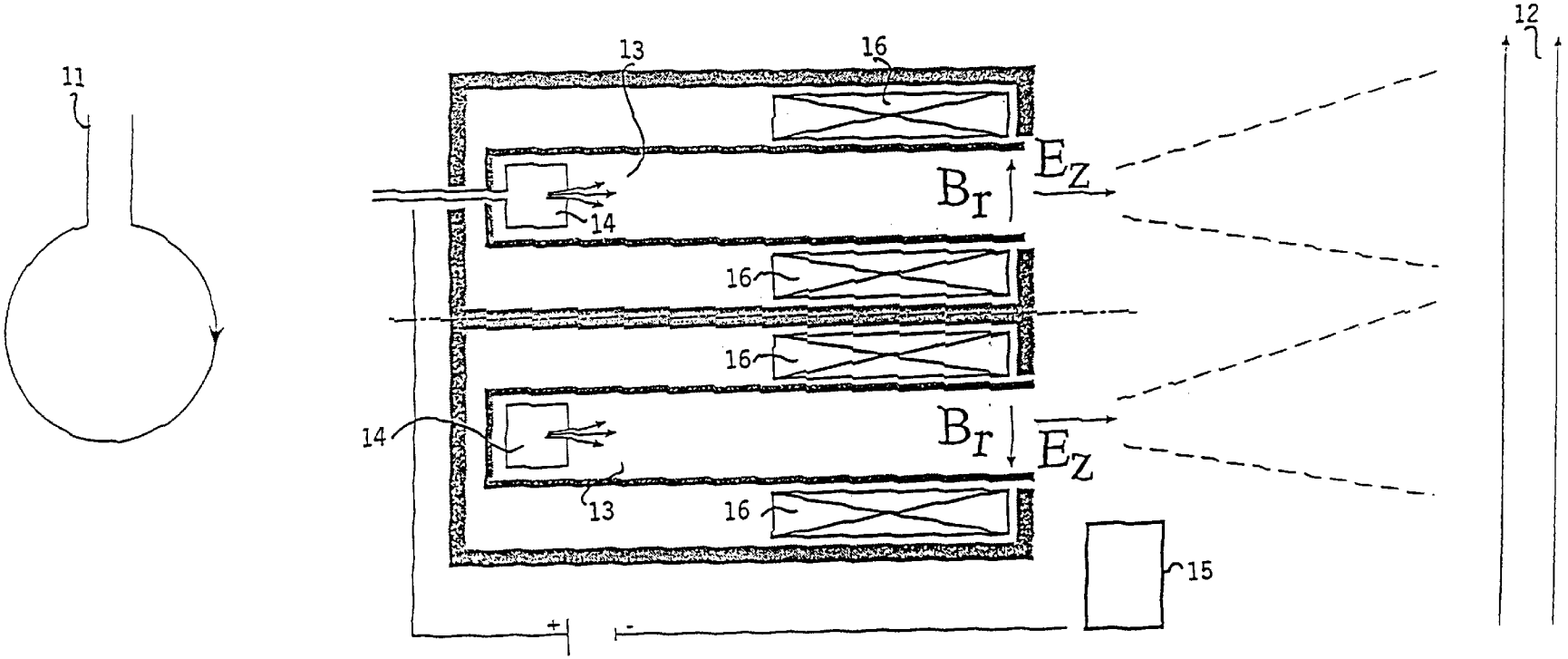

FIG. 1 The novel system.

Figure 2:
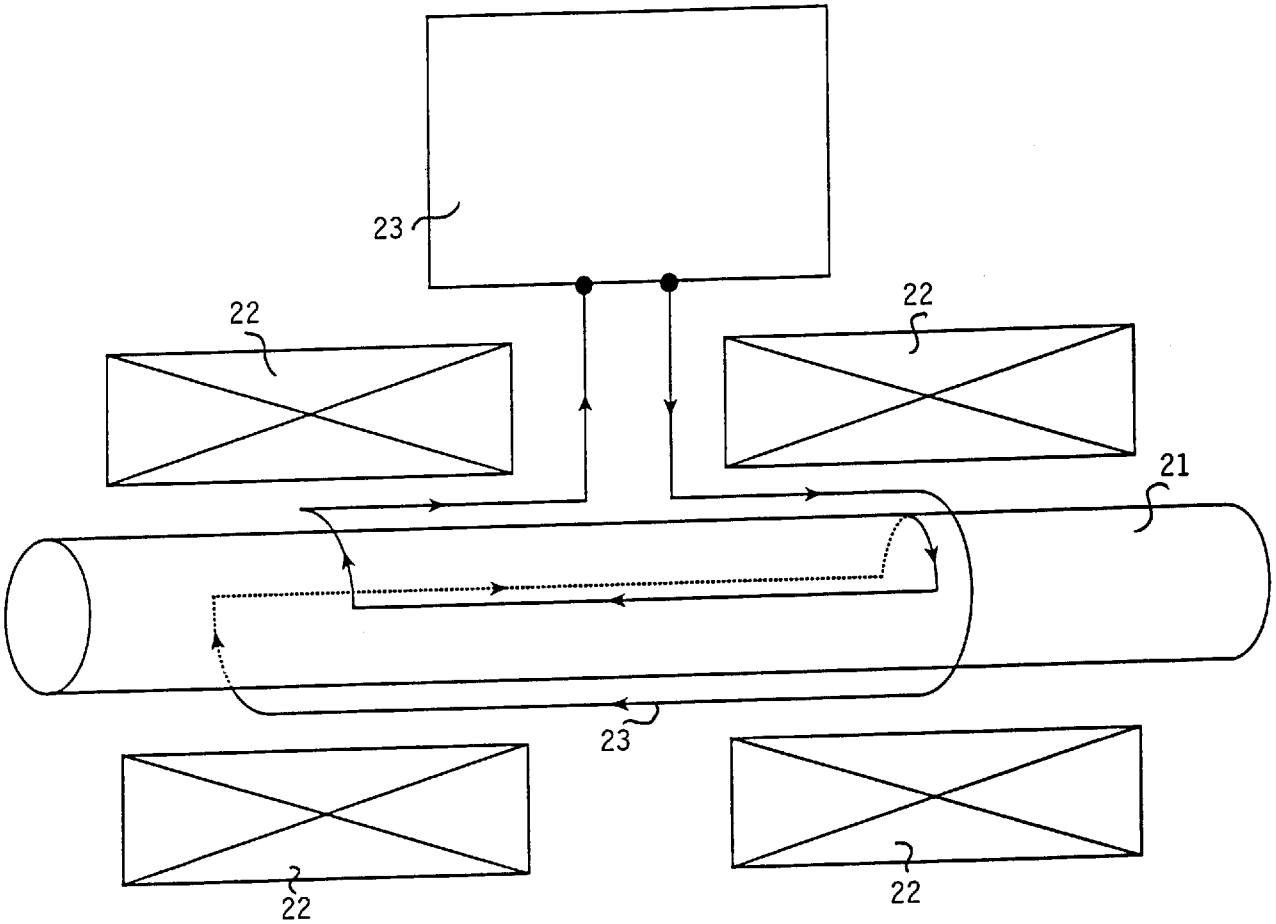

FIG. 2 A Helicon source.

Figure 3:
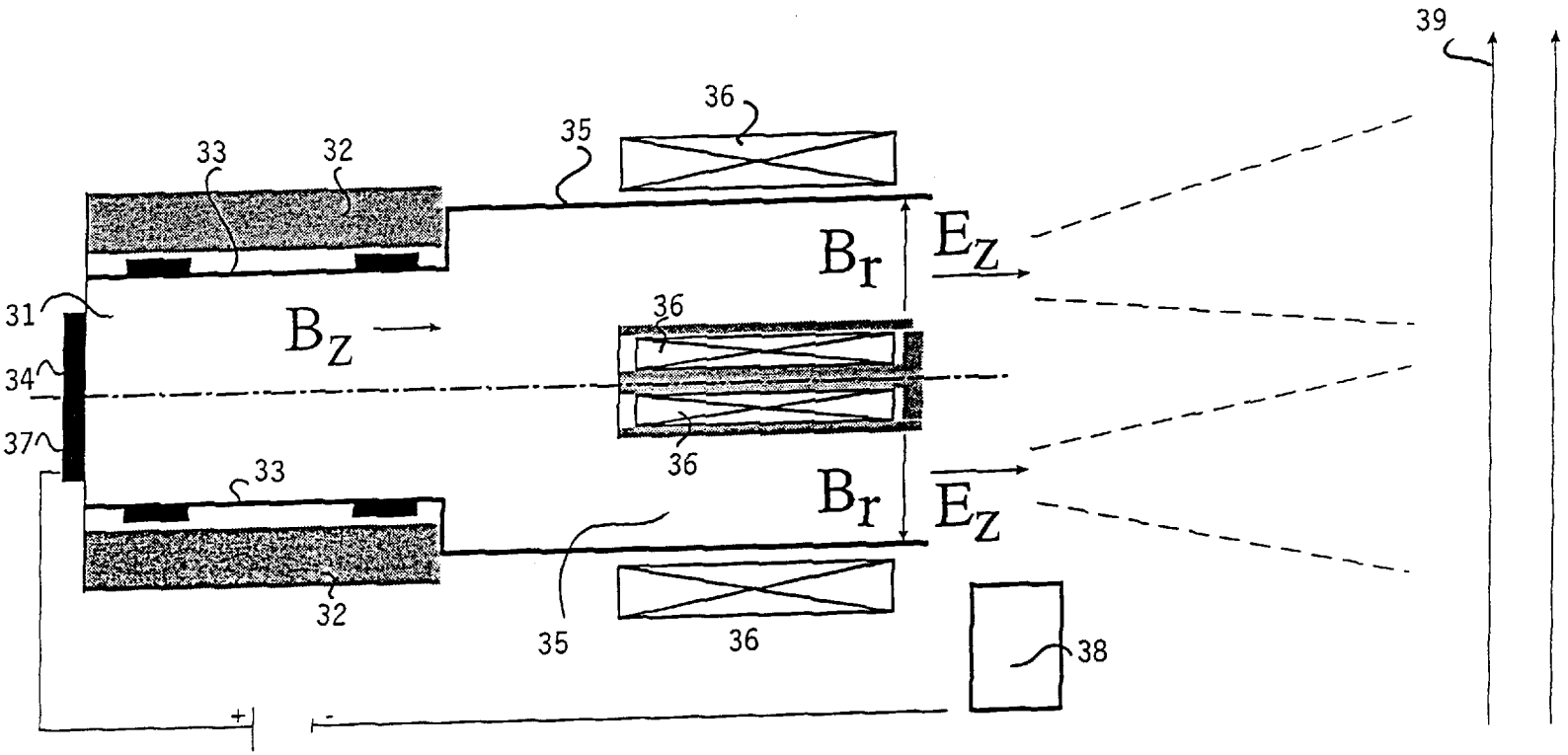

FIG. 3 A configuration with a helicon source in series with the accelerating field.

Figure 4:
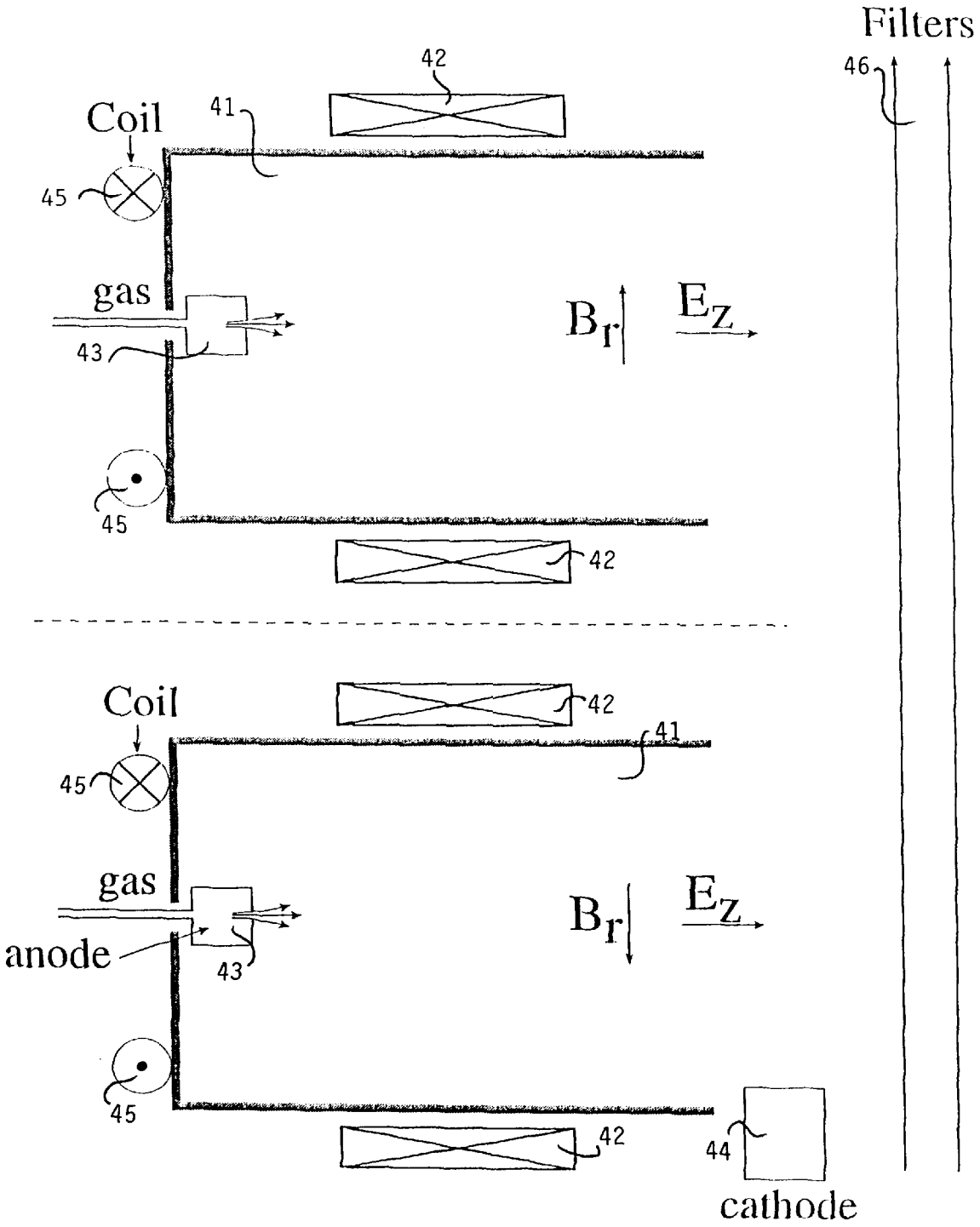

FIG. 4 A configuration that uses the vertical magnetic field for the Helicon propagation.

Figure 5:
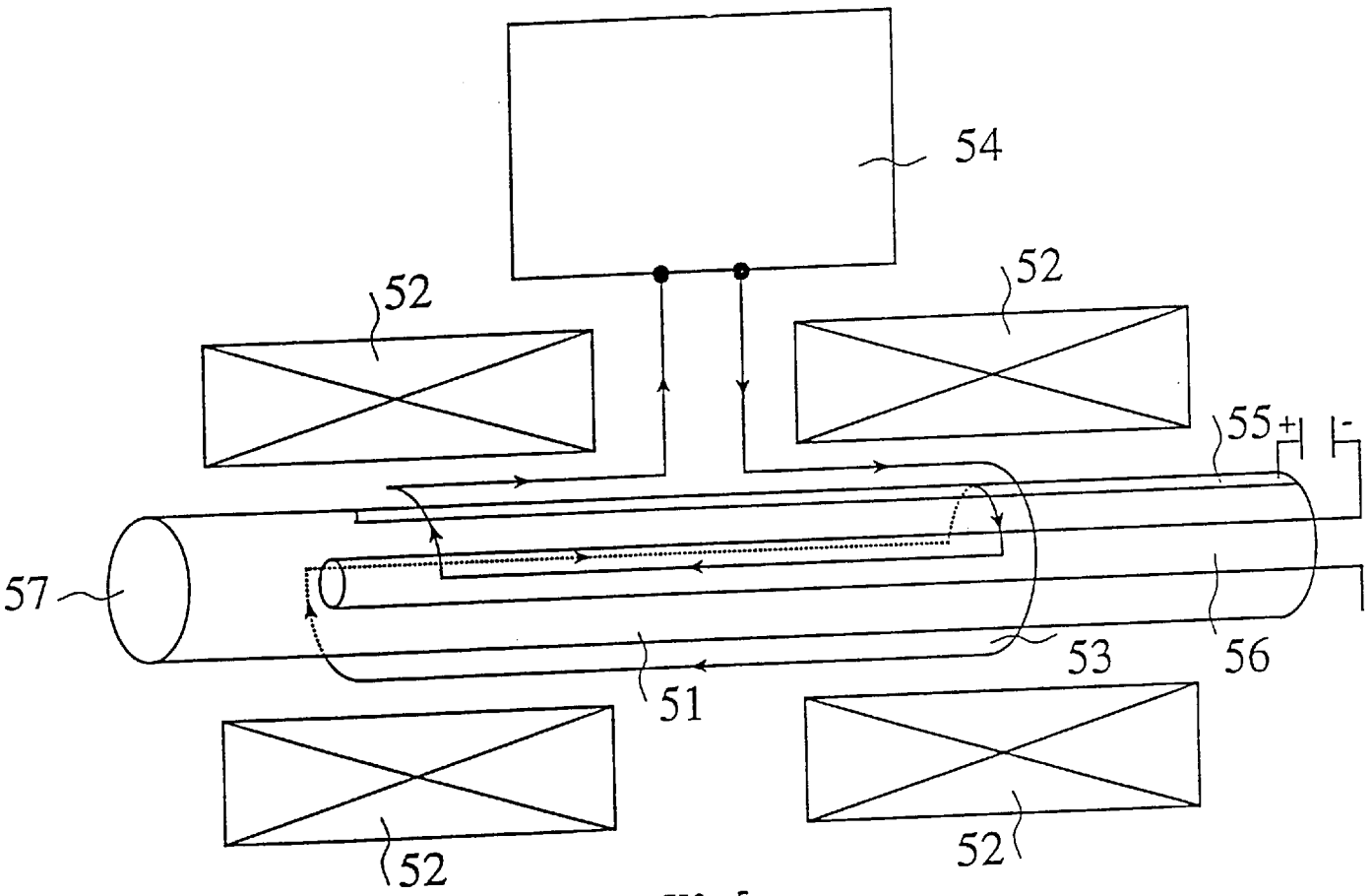

FIG. 5 A configuration of a separate component for the plasma generation that heats drifting electrons. The separate component can be used as high density plasma generator, with no relation to the neutral beam source.

Figure 6:
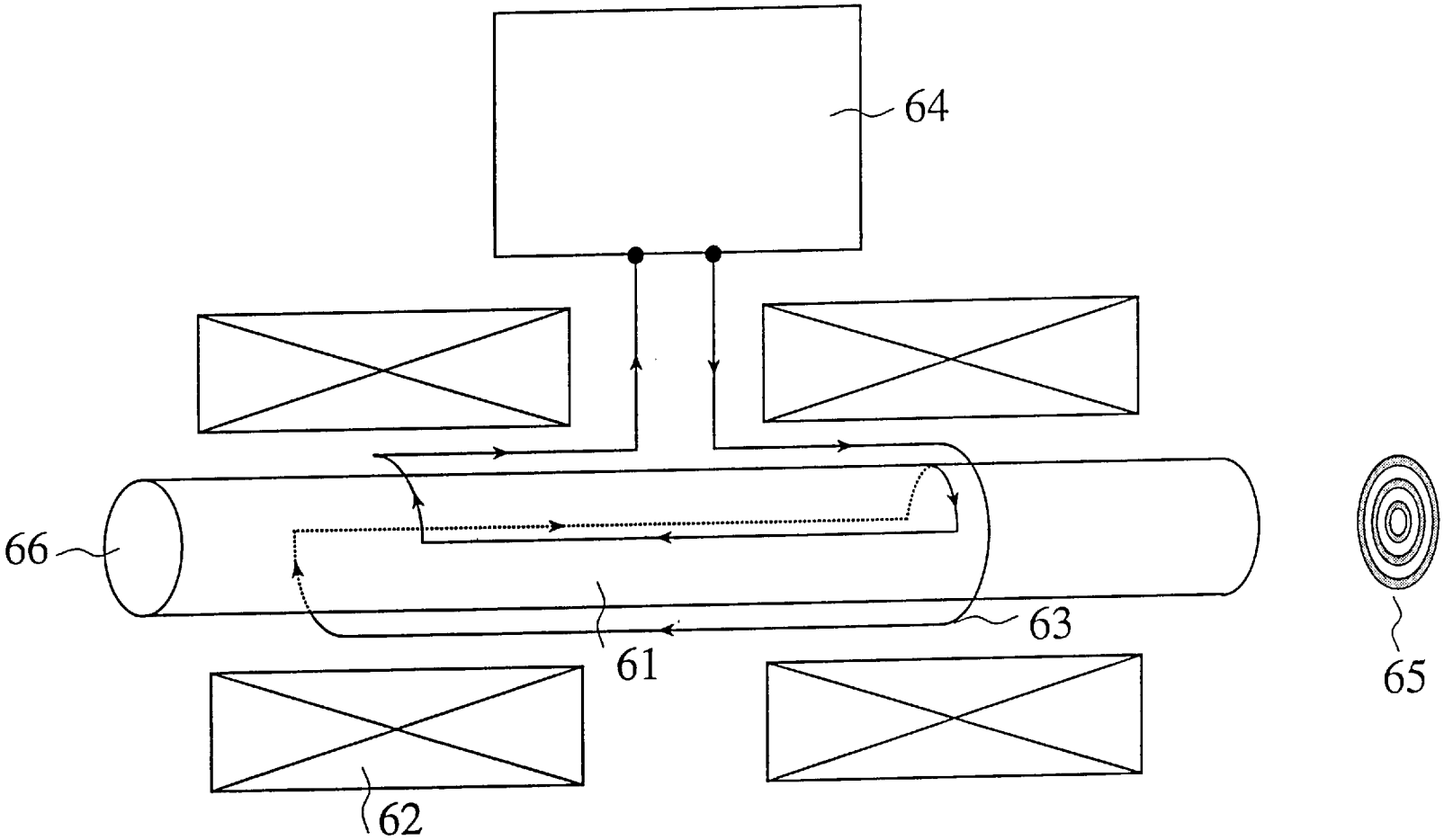

FIG. 6 A configuration of a separate component for the plasma generation that heats the drifting electrons, similarly to FIG. 5. The DC electric field is generated in a way different than in FIG. 5.

FIG. 1—illustrates the novel system. The first component, the wave source (11), is shown only schematically, also the filtering system (12) is shown schematically. The filtering system can be a magnetic field of a configuration that diverts the charged particles and allows only neutral ones to pass. It can also be a set of grids that repel charged particles or a system that effects charge exchange and recombination by collisions with gas atoms. As wave source, existing wave sources, such as an ECR or a Helicon source, can be employed. Such sources can be modified to better fit the novel device. There is also provided a novel source. The second component is similar to the Hall thruster. The plasma is contained in a cylindrical vessel (13). An applied voltage between an anode (14) and a cathode (15) accelerates ions electrically to the right and draws electrons to the left. Magnets (16) that are spread azimuthally around the vessel produce a radial magnetic field that reduces the electron mobility along the electric field.

Possible configurations are as follows:

I The neutral beam source with a helicon source as plasma generator;

Here we describe a configuration in which a helicon source is the plasma generator. An illustration of a helicon source is given in FIG. 2. The cylindrical chamber (21) is surrounded by magnet coils (22) that generate an axial magnetic field. An antenna (23) excites helicon waves in the plasma, which accelerate some of the plasma electrons, mainly via Landau damping. The accelerated electrons gain enough energy (typically several tens of eVs) to enable them to ionize gas atoms in the chamber.

When a helicon source is employed as plasma generator in the neutral beam device, it can be separate from the accelerating unit and mounted in series with the vertical magnetic field. This configuration is shown in FIG. 3. In this configuration the intensities of the axial magnetic field in the helicon source and of the radial magnetic field in the accelerating zone can be different, which allows flexibility in the choice of parameters, according to the different requirements of the plasma generation and acceleration.

We now describe in more detail the device that is shown schematically in FIG. 3.

The device comprises three parts: a helicon source, an accelerator and deflecting magnets.

The helicon source is a 20 cm diameter cylindrical Pyrex (31) tube of 20 cm length surrounded by solenoidal magnets (32) and a Nagoya Type III antenna (33). The longitudinal magnetic field intensity is 200 G and the antenna radiates 3 kW power of 13.56 MHz waves into the tube. An argon gas flows into the tube from the left (34) so that the gas pressure in the tube is 5 m Torr. A $10^{12}$ cm$^{-3}$ plasma is formed in the tube and flows to the right into the accelerator (35). The accelerator is of the Hall thruster configuration. It is composed of a hollow cylinder, the inner and outer walls of which are of 10 cm and 30 cm diameter respectively. A magnetic circuit (36) generates a radial magnetic field of intensity 100 G across the 20 cm long acceleration zone. A 20 Volt voltage is applied between the left side of the helicon source, which serves as an anode (37), and a cathode (38) that is placed at the exit to the right of the radial magnetic field region. To the right of the accelerator (39) a 300 G vertical magnetic field is applied along 20 cm.

The plasma is formed mainly through ionization in the helicon source. The ions are then drawn by the applied electric field into the Hall acceleration region. The cathode emits electrons that provide charge neutralization in the acceleration zone. In the 5 mTorr pressure gas the mean free path for charge exchange between argon ions and neutral atoms is about 10 cm. Since the length of the acceleration zone (in which the applied electric field exists) is 20 cm, the flux of neutral atoms that acquire few eV energy is comparable to the flux of ions, both are about 0.1 A/cm$^2$ of equivalent current. The vertical magnetic field at the exit (39) filters out ions, deflecting them to the walls. Only neutral atoms exit to the right. A flux of neutral atoms, of an equivalent current of 100 A at energies of 10 eV at a cylindrical cross section of a diameter 30 cm, is generated.

II A different configuration for the helicon source

An alternative configuration, in which the radial magnetic field that reduces the electron mobility also supports the helicon propagation and absorption in the plasma, is shown in FIG. 4.

A gas is introduced into a hollow cylindrical chamber (41). Magnets (42) generate a radial magnetic field and a DC voltage is applied between the anode (43) and the cathode (44), as is the case in the Hall thruster. An antenna, that is composed of two rings (45), launches helicon waves along the radial magnetic field itself. This configuration has less freedom than the configuration in FIG. 3, however, it is more compact, and the ion flux is less susceptible to wall losses. The configuration also comprises of filters (46), DC power supplies for the accelerating voltage and for the magnetic circuit and an AC power supply for the antenna.

III A novel ionizer as the plasma source.

In addition, an efficient plasma heating means are provided, where waves are used for plasma generation. These means are more efficient as a plasma source than the conventional helicon source. We describe here this novel source. It can replace the helicon source in the neutral beam source (part 11 in FIG. 1 and part 31 in FIG. 3).

In this novel configuration the heated electrons drift in crossed electric and magnetic fields. The wave absorption was analyzed for waves at frequencies lower than the ion cyclotron frequency, but it should occur at higher frequencies as well, such as in helicon frequencies.

Comparing the Q of the cavity for waves in which the absorption is a result of the electron drift to the Q of the cavity for helicon waves in which the absorption results from the electron inertia, we find the ratio to be:

$$\frac{Q_{drift}}{Q_{H}} = \left(\frac{\omega}{\omega_p}\right)^2 \left(\frac{\omega}{kv_d}\right)^2 \frac{r_L}{a}.$$

Here $\omega$ and k are the wave frequency and wave number along the applied magnetic field, $\omega_p$ is the electron plasma frequency, $v_d$ is the electron drift velocity in the applied crossed electric and magnetic fields, $r_L$ is the electron Larmor radius and "a" is a characteristic dimension of the vessel. For plasma densities of $10^{13}$ $cm^{-3}$, magnetic field of 200 G, a of 15 cm, and a wave frequency of 13.6 MHz, this ratio is $10^{-5}$, indicating that the proposed mechanism is expected to be much more efficient than the present helicon mechanism.

The heating due to the electron drift is present in the configuration of FIG. 4 where helicon waves propagate in a plasma of drifting electrons. Therefore, this heating mechanism competes there with the regular absorption of helicon waves. Alternatively, the configuration in FIG. 3 can be modified, as is shown in FIG. 5 and described in the following:

IV. The Novel Plasma Source as a Separate Component

The plasma source can be separate and mounted in series with the accelerator.

Since this is a very efficient ionizer, the part in FIG. 5 can be used solely for plasma generation. The above values of the cavity Q demonstrate that a high plasma density can be efficiently achieved.

Example

Let us describe a working example of the plasma source, shown in FIG. 5. A 20 cm diameter cylindrical Pyrex tube of length 20 cm (51) is surroundedby solenoidal magnets (52) and a Nagoya Type III antenna (53) connected to an RF power supply (54). The longitudinal magnetic field intensity is 200 G and the antenna radiates 5 kW power of 13.56 MHz waves into the tube. This part of the device is similar to the helicon source that was used for the plasma generation in the neutral beam source. In addition, six aluminum rods (55) (only one is shown) are mounted on the inner side of the Pyrex cylinder, uniformly spread azimuthally. A cylindrical aluminum rod (56) of 8 cm diameter is placed along the axis of the vessel. A 20 Volt voltage is applied between the inner rod and the outer aluminum rods.

An argon gas is introduced into the tube from the left (57) so that the gas pressure in the tube is 5 m Torr. The generated plasma drifts azimuthally in the crossed radial electric field and axial magnetic field. As a result of the absorption of the waves by the drifting electrons a $5{:}10^{12}$ $cm^{-3}$ plasma is generated in the tube.

A radial DC electric field can also be generated inside the plasma without the aluminum rods. An example is shown in FIG. 6. As in FIG. 5, a 20 cm diameter cylindrical Pyrex tube of 20 cm length (61) is surrounded by solenoidal magnets (62) and an antenna (63) connected to an RF power supply (64). The longitudinal magnetic field intensity is 200 G and the antenna radiates 5 kW power of 13.56 Mhz waves into the tube. Here several metal rings of different radii are mounted at the cylinder edge (65), and are held at different potentials. Such rings, named plasma potential control rings, were used in a tandem mirror configuration[7]. Since the potential in the plasma is uniform along a magnetic field line, the varying potentials imposed on the rings create a radial potential variation inside the cylindrical plasma. The antenna launches helicon waves that are efficiently absorbed by the drifting electrons and a dense plasma is generated. An argon gas is introduced into the tube from the left (66) so that the gas pressure in the tube is 5 m Torr. The generated plasma drifts azimuthally in the crossed radial electric field and axial magnetic field. As a result of the absorption of the waves by the drifting electrons a $5{\cdot}10^{12}cm^{-3}$ plasma is generated in the tube.

REFERENCES

1. M. A. Lieberman and A. J. Lichetenberg, in "Principles of plasma discharges and materials processing" (John Wiley, New York, 1994), Ch 13.
2. F. F. Chen, "Plasma ionization by helicon waves", Plasma physics and controlled fusion 33, 339 (1991).
3. A. I. Morozov, Yu. V. Esipchuk, G. N. Ticinin, A. V. Trofinov, Yu. A. Sharov, and G. Ya. Shaepkin, "Plasma acceleration with closed electron drift and extended acceleration zone", Sov. Phys. Tech. Phys. 17, 38 (1972).
4. J. Ashkenazy, Y. Raitses, and G. Appelbaum, "Investigations of a laboratory model Hall thruster", AIAA 95-2673.
5. A. Fruchtman, "Electron heating by waves in the ion-cyclotron frequency range", Phys. Fluids 28, 2188 (1985).
6. A. Fruchtman and W. F. Cummins, "Absorption of waves at the ion-cyclotron frequency range by drifting electrons", Phys. Fluids 30, 1569 (1987).
7. G. D. Severn, N. Hershkowitz, R. A. Breun, and J. R. Ferron, "Experimental studies of the rotational stability of a tandem mirror with quadrupole end cells", Phys. Fluids B 3, 114 (1991); G. D. Severn and N. Hershkowitz, "Radial control of the electrostatic potential in a tandem mirror with quadrupole end cells", Phys. Fluids B 4, 3210 (1992).

I claim:

1. A method of generating a high flux density neutral atom or molecule beam which comprises:

generating a plasma of electrons and ionized atoms or molecules, applying a voltage across the plasma, accelerating the ions in one direction and drawing an electron flow in the opposite direction, establishing a magnetic field perpendicular to the electric field decreasing electron mobility along the direction of the electric field, positioning a cathode close to the exit of the beam emitting electrons providing charge neutralization, effecting a charge exchange between accelerated ionized atoms or molecules and neutral atoms or molecules and converting moving ions to moving neutral atoms or molecules, coupling a plasma generating source selected from a helicon source, an ECR source, or a novel source, removing the charged entities from the flow by passing the plasma through an electrostatic or magnetic filter to filter out charge entities, or by effecting charge exchange and recombination, thus providing a neutral atom or molecule beam.

2. A method according to claim 1, where there is used a Hall thruster type plasma accelerator.

3. A method according to claim 1, where the electric field applied is parallel to the axis of the tube of the device.

4. A method according to claim 1, where the plasma generation is enhanced by an antenna radiating between about 50 W to about 50 KW into the tube of the generator and there is maintained in the generator a gas pressure of an inert gas from about 0.1 m Torr to about 1 Torr.

5. A method according to claim 1, where a vertical magnetic field or an electric field is used to filter out ions.

6. A method according to claim 1, where effecting charge exchange or recombination is used to filter out ions.

7. A plasma generating device, for use in a method according to claim 1, and for other uses, where the plasma is generated as a result of absorption of waves by electrons that drift in crossed electric and magnetic fields, where there is used a magnetic field of between about 30 G and about 10 KG, and where a wave of frequency from about 0.5 MHz and about 1 GHz is used.

8. A generator according to claim 7, comprising plasma generating means in the form of an antenna radiating between about 50 W to about 50 KW into the tube of the generator and in the form of crossed electric and magnetic fields, and means for maintaining in the generator a gas pressure of an inert gas from about 0.1 m Torr to about 1 Torr.

9. A system for generating a high flux neutral atom or molecular beam comprising:

plasma generating means for accelerating the positively charged ions in one direction and the negatively charged electrons in the opposite direction, means for establishing a magnetic field perpendicular to the electric field decreasing electron mobility along the direction of the electric field, positioning a cathode close to the exit of the ion beam emitting electrons providing charge neutralization, means for effecting a charge exchange between accelerated ionized atoms or molecules and neutral atoms or molecules, and means for filtering out charged entities, resulting in a neutral atom or molecule beam.

10. A system according to claim 9, where the plasma generator is an ECR, or a helicon source.

* * * * *